US010026537B2

(12) United States Patent
Bjoerkhaug

(10) Patent No.: US 10,026,537 B2
(45) Date of Patent: Jul. 17, 2018

(54) FAULT TOLERANT SUBSEA TRANSFORMER

(71) Applicant: ONESUBSEA IP UK LIMITED, London (GB)

(72) Inventor: Andreas Bjoerkhaug, Bergen (NO)

(73) Assignee: ONESUBSEA IP UK LIMITED, London (GB)

( * ) Notice: Subject to any disclaimer, the term of this patent is extended or adjusted under 35 U.S.C. 154(b) by 0 days.

(21) Appl. No.: 14/631,649

(22) Filed: Feb. 25, 2015

(65) Prior Publication Data

US 2016/0247622 A1 Aug. 25, 2016

(51) Int. Cl.

| | |
|---|---|
| ***H01F 27/16*** | (2006.01) |
| ***H01F 27/04*** | (2006.01) |
| ***H01F 27/28*** | (2006.01) |
| ***H01F 27/40*** | (2006.01) |
| ***H01F 27/14*** | (2006.01) |
| ***H01F 27/34*** | (2006.01) |

(52) U.S. Cl.

CPC ..... *H01F 27/16* (2013.01); *H01F 27/04* (2013.01); *H01F 27/14* (2013.01); *H01F 27/2823* (2013.01); *H01F 27/343* (2013.01); *H01F 27/402* (2013.01); *H01F 2027/406* (2013.01)

(58) Field of Classification Search

CPC ..... H01F 27/14; H01F 27/12; H01F 27/02

See application file for complete search history.

(56) References Cited

U.S. PATENT DOCUMENTS

| | | | | |
|---|---|---|---|---|
| 1,923,727 A * | 8/1933 | Hodnette | H01F 27/402 218/158 |
| 2,949,849 A | 8/1960 | Gundlach | |
| 3,666,992 A | 5/1972 | Goodman | |
| 3,760,314 A * | 9/1973 | Krasienko | H01F 27/40 336/92 |
| 4,138,699 A | 2/1979 | Ura et al. | |
| 4,789,363 A | 12/1988 | Wicklein | |

(Continued)

FOREIGN PATENT DOCUMENTS

| | | |
|---|---|---|
| CA | 2097120 A1 | 12/1993 |
| EP | 2570585 A1 | 3/2013 |

(Continued)

OTHER PUBLICATIONS

International Search Report for International application No. PCT/EP2016/052418 dated Apr. 28, 2016.

(Continued)

*Primary Examiner* — Mangtin Lian
*Assistant Examiner* — Malcolm Barnes
(74) *Attorney, Agent, or Firm* — Fletcher Yoder, P.C.

(57) ABSTRACT

According to some embodiments, subsea fault tolerant transformer includes an arrangement of two tanks mounted one above the other. A lower tank houses the transformer windings and core and is below and abutting an upper tank. Both tanks are filled with respective dielectric oil. The electrical terminals for the primary and secondary power connections are on the second/instrument tank and the conductors pass through the instrument tank and then through the shared wall to the transformer tank. The design allows for enhanced cooling of the transformer through a single wall portion of the lower tank as well as fault tolerance associated with double barriers.

20 Claims, 7 Drawing Sheets

(56) References Cited

U.S. PATENT DOCUMENTS 4,975,797 A 12/1990 Veverka et al.
5,131,464 A 7/1992 Lenhart et al.
5,179,489 A 1/1993 Oliver
5,272,442 A 12/1993 Schemmel et al.
5,324,886 A * 6/1994 Nakatake ..... H01F 27/14 174/12 R
5,515,230 A 5/1996 Ashley
5,659,219 A 8/1997 Momose et al.
5,699,219 A 12/1997 Arita et al.
5,764,129 A 6/1998 Syouji et al.
6,014,894 A 1/2000 Herron
6,188,552 B1 * 2/2001 Jaeschke ..... E21B 43/128 361/111
6,580,783 B1 6/2003 Swale
6,595,487 B2 7/2003 Johansen et al.
6,626,470 B1 9/2003 Appleford et al.
6,867,364 B2 * 3/2005 Hafskjold ..... H01F 27/14 336/90
7,202,619 B1 4/2007 Fisher
7,301,739 B2 11/2007 Hamer
7,516,795 B2 4/2009 Lopes Euphemio et al.
7,598,751 B2 10/2009 Collins, Jr. et al.
7,847,189 B2 * 12/2010 Findeisen ..... H01F 27/14 336/90
8,108,162 B2 1/2012 Matsumoto
8,362,789 B2 1/2013 Collins, Jr. et al.
8,439,080 B2 * 5/2013 Uusipaikka ..... H01F 27/14 138/26
8,456,116 B2 6/2013 Burdick
8,549,924 B2 10/2013 Virtanen et al.
9,056,663 B2 6/2015 Bø
9,308,618 B2 4/2016 Benvegnu
9,845,910 B2 * 12/2017 Knoener ..... F16L 55/04
2002/0175522 A1 11/2002 Wacknov et al.
2004/0065873 A1 4/2004 Peterson
2004/0135528 A1 7/2004 Yasohara et al.
2008/0144442 A1 6/2008 Combee et al.
2009/0056936 A1 3/2009 McCoy, Jr.
2009/0234600 A1 9/2009 Matsumoto
2010/0026317 A1 2/2010 Collins, Jr. et al.
2010/0089126 A1 4/2010 Sweeney
2010/0288501 A1 11/2010 Fielder et al.
2011/0000677 A1 1/2011 Overfield
2011/0043999 A1 * 2/2011 Johnston ..... B03C 3/68 361/699
2011/0089767 A1 4/2011 Rocke et al.
2011/0093216 A1 * 4/2011 Andersson ..... H01F 27/14 702/24
2011/0140820 A1 * 6/2011 Guentert, III ..... H01F 27/12 336/58
2011/0188392 A1 8/2011 Misumi et al.
2011/0251728 A1 10/2011 Batho et al.
2011/0304289 A1 12/2011 Burdick
2011/0316659 A1 12/2011 Puchianu et al.
2012/0001482 A1 1/2012 Burdick
2013/0033103 A1 2/2013 McJunkin et al.
2013/0063842 A1 3/2013 Kataoka
2013/0220625 A1 8/2013 Billington et al.
2014/0035504 A1 2/2014 Rongve et al.
2014/0035759 A1 2/2014 Ramsfjell et al.
2014/0097678 A1 4/2014 Thibaut et al.
2014/0147243 A1 5/2014 Torkildsen et al.
2014/0209289 A1 * 7/2014 Boot ..... E21B 41/0085 166/65.1
2014/0217947 A1 8/2014 Haugan
2014/0347897 A1 11/2014 Broussard et al.
2015/0016812 A1 1/2015 Radan et al.
2015/0070802 A1 3/2015 Dong
2015/0188297 A1 * 7/2015 Boe ..... H01F 27/14 174/564
2015/0346266 A1 * 12/2015 Dimino ..... G01R 31/025 702/59
2016/0181964 A1 6/2016 Nojima
2017/0082764 A1 3/2017 Lasante et al.
2017/0280577 A1 * 9/2017 Laneryd ..... H05K 5/068

FOREIGN PATENT DOCUMENTS

EP 2610881 A1 * 3/2013 ..... H01F 27/14
EP 2610881 A1 7/2013
GB 2028003 A 2/1980
WO 2005111484 A2 11/2005
WO 2008055515 A1 5/2008

OTHER PUBLICATIONS

International Preliminary Report on Patentability for International application No. PCT/EP2016/052418 dated Aug. 29, 2017.
International Search Report for International application No. PCT/EP2016/052424 dated Apr. 14, 2016.
International Preliminary Report on Patentability for International application No. PCT/EP2016/052424 dated Aug. 29, 2017.
International Search Report for International application No. PCT/EP2016/052422 dated Jul. 13, 2016.
International Preliminary Report on Patentability for International application No. PCT/EP2016/052422 dated Aug. 29, 2017.

* cited by examiner

FIG. 4
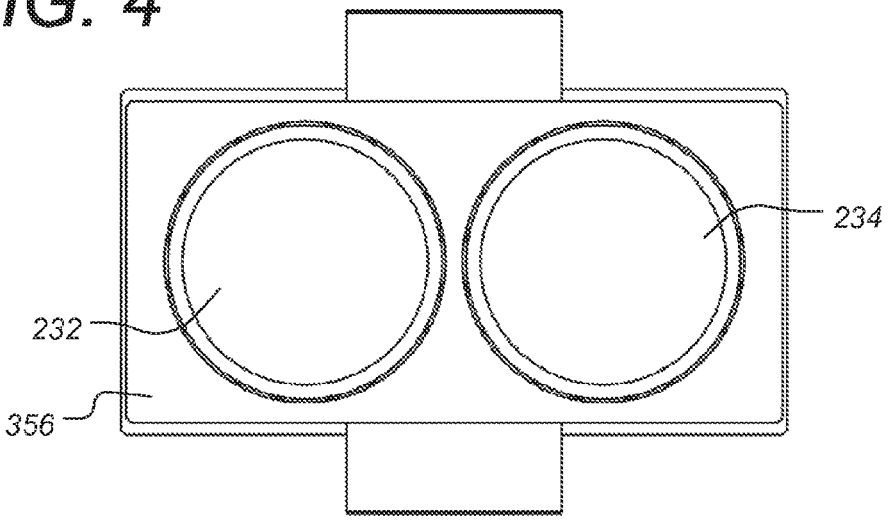
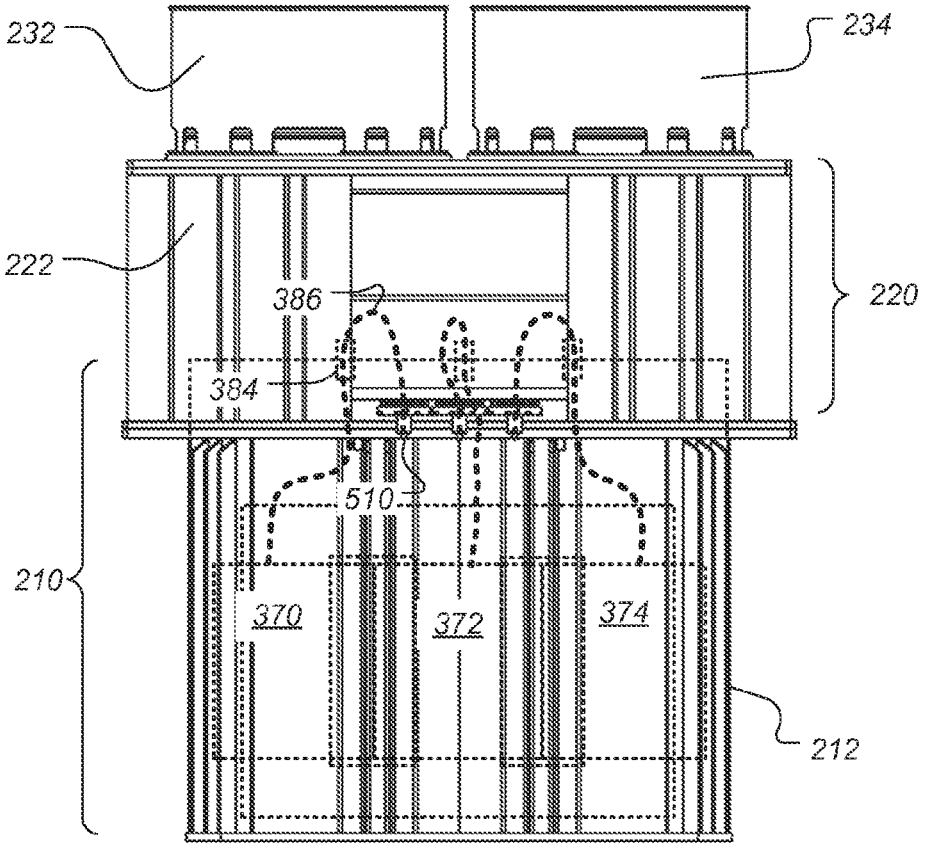
FIG. 5

800

FAULT TOLERANT SUBSEA TRANSFORMER

TECHNICAL FIELD

The present disclosure relates to subsea power transformers. More particularly, the present disclosure relates to fault tolerant three-phase subsea power transformers suitable for long-term seafloor deployment.

BACKGROUND

In the subsea oil and gas industry, it is often desirable to perform certain fluid processing activities on the sea floor. Examples include fluid pumps (both single phase and multiphase) and compressors (both gas compressors and "wet gas" compressors). The subsea pumps and compressors are commonly driven with electric motors, which are supplied by three-phase electrical power via one or more umbilical cables from a surface facility. Especially in cases where the umbilical cable is relatively long, it is desirable to transmit the electrical power at higher voltages through the umbilical cable and use a subsea transformer to step-down to a voltage suitable for use by the subsea electric motors.

The subsea transformer components are often submerged in a transformer oil that is contained within a tank. However, the pass through points of the tank wall, such as for the electrical connections with the supply and load conductors, are potential sources of failure. In order to increase reliability, some subsea transformers have used a "tank-in-a-tank" arrangement that is schematically illustrated in FIG. 10. In some cases a standard transformer tank that is of a type commonly used in surface applications is used as the inner tank, which is then enclosed in a second, outer tank. The tank-in-a-tank designs thus are able to provide a double barrier between the seawater and the active components (windings and core) of the transformer.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A subsea transformer is described that includes: a primary set of coil windings; a secondary set of coil windings; and a first sealed tank defined by a first tank wall that houses the primary and secondary sets of coil windings and a first dielectric oil which bathes the primary and secondary sets of coil windings. The first tank wall is configured for long-term deployment in a subsea environment. The transformer further includes a second sealed tank which houses a second dielectric oil and is positioned adjacent to the first sealed tank such that the first and second tanks share a portion of the first tank wall; a set of primary terminals mounted on the second tank connected to a first electrical conduction path to the primary set of coil windings and passing through the second tank, the shared portion of the first tank wall and into the first tank. The transformer further includes a set of secondary terminals mounted on the second tank, connected to a second electrical conduction path to the secondary set of coil windings and passing through the second tank, the shared portion of the first tank wall, and into the first tank.

According to some embodiments, the shared portion of the first tank wall is less than about 50% of the total surface area of the first tank, and the non-shared portion of the first tank wall is configured for direct contact with ambient seawater that provides cooling to the first dielectric oil. According to some embodiments, the shared portion of the first tank wall is less than about 30% of the total surface area of the first tank. The subsea transformer can remain operational when either (1) seawater leaks in to the second tank but no leak exists between the first and second tanks, or (2) when a leak exists between the first and second tanks but no seawater leaks into the second tank.

According to some embodiments, the transformer also includes: a first pressure compensator in fluid communication with the first tank and configured to balance internal pressure of the first tank with ambient seawater pressure and/or pressure within the second tank; and a second pressure compensator in fluid communication with the second tank and configured to balance internal pressure of the second tank with ambient seawater pressure. The first pressure compensator can be housed within the second tank.

According to some embodiments, instruments can be housed within the second tank, and a temperature sensor in the first tank can be used to measure temperature of the first dielectric oil. According to some embodiments, an integrated high resistance grounding system is housed within the first tank interconnected and configured to provide a high resistance ground path between a neutral node of the secondary windings and a ground. According to some other embodiments, a seawater based high resistance grounding system can be mounted to an exterior portion of the subsea transformer and exposed to ambient seawater.

The transformer can be configured to supply power to a subsea motor used for processing hydrocarbon-bearing fluids produced from a subterranean rock formation. The subsea motor can be used to drive subsea device such as a subsea pump, compressor or separator.

BRIEF DESCRIPTION OF THE DRAWINGS

The subject disclosure is further described in the detailed description which follows, in reference to the noted plurality of drawings by way of non-limiting examples of embodiments of the subject disclosure, in which like reference numerals represent similar parts throughout the several views of the drawings, and wherein:

FIGS. 4, 5, 6 and 7 are top, front, bottom and side views of a fault tolerant subsea transformer, according to some embodiments.

DETAILED DESCRIPTION

The particulars shown herein are by way of example, and for purposes of illustrative discussion of the embodiments of the subject disclosure only and are presented in the cause of providing what is believed to be the most useful and readily understood description of the principles and conceptual aspects of the subject disclosure. In this regard, no attempt is made to show structural details of the subject disclosure in more detail than is necessary for the fundamental understanding of the subject disclosure, the description taken with the drawings making apparent to those skilled in the art how the several forms of the subject disclosure may be embodied in practice. Further, like reference numbers and designations in the various drawings indicate like elements.

Figure 8:
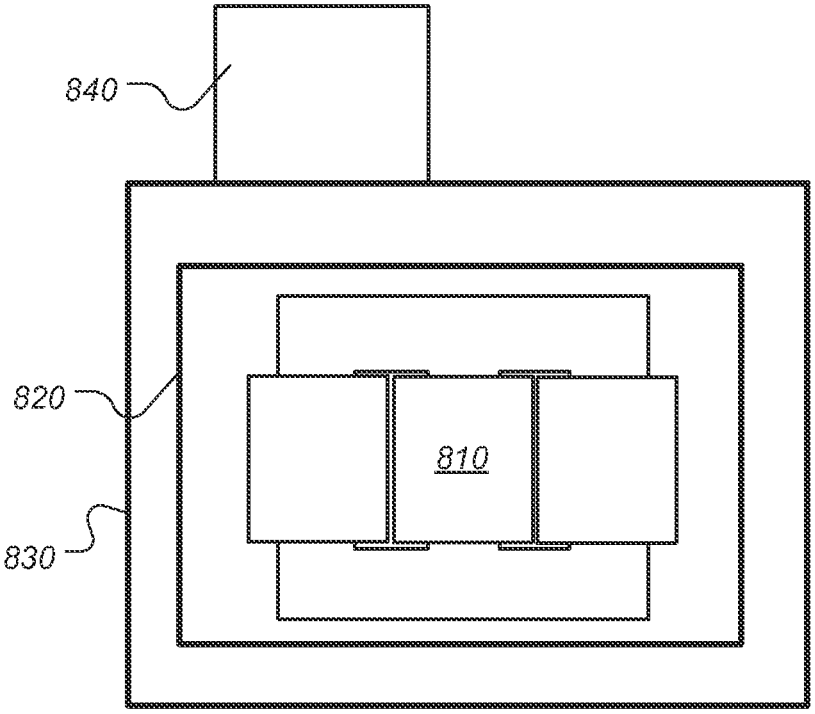
FIG. 8 (Prior Art)
FIG. 8 is a schematic diagram illustrating aspects of a known subsea transformer.

Known tank-in-a-tank designs, such as shown in FIG. 8, are used to provide a double barrier between the seawater and the active components (windings and core) of the transformer. However, with the additional tank surrounding the transformer tank, such designs do benefit from ambient seawater cooling when compared to single tank designs. According to some embodiments, an arrangement of two tanks is described wherein a transformer housing the windings and core is positioned adjacent to and shares a wall with an instrument tank. Both tanks are filled with respective dielectric oil. The electrical terminals for the primary and secondary power connections are on the second/instrument tank and the conductors pass through the instrument tank, and then through the shared wall to the transformer tank.

Figure 1:
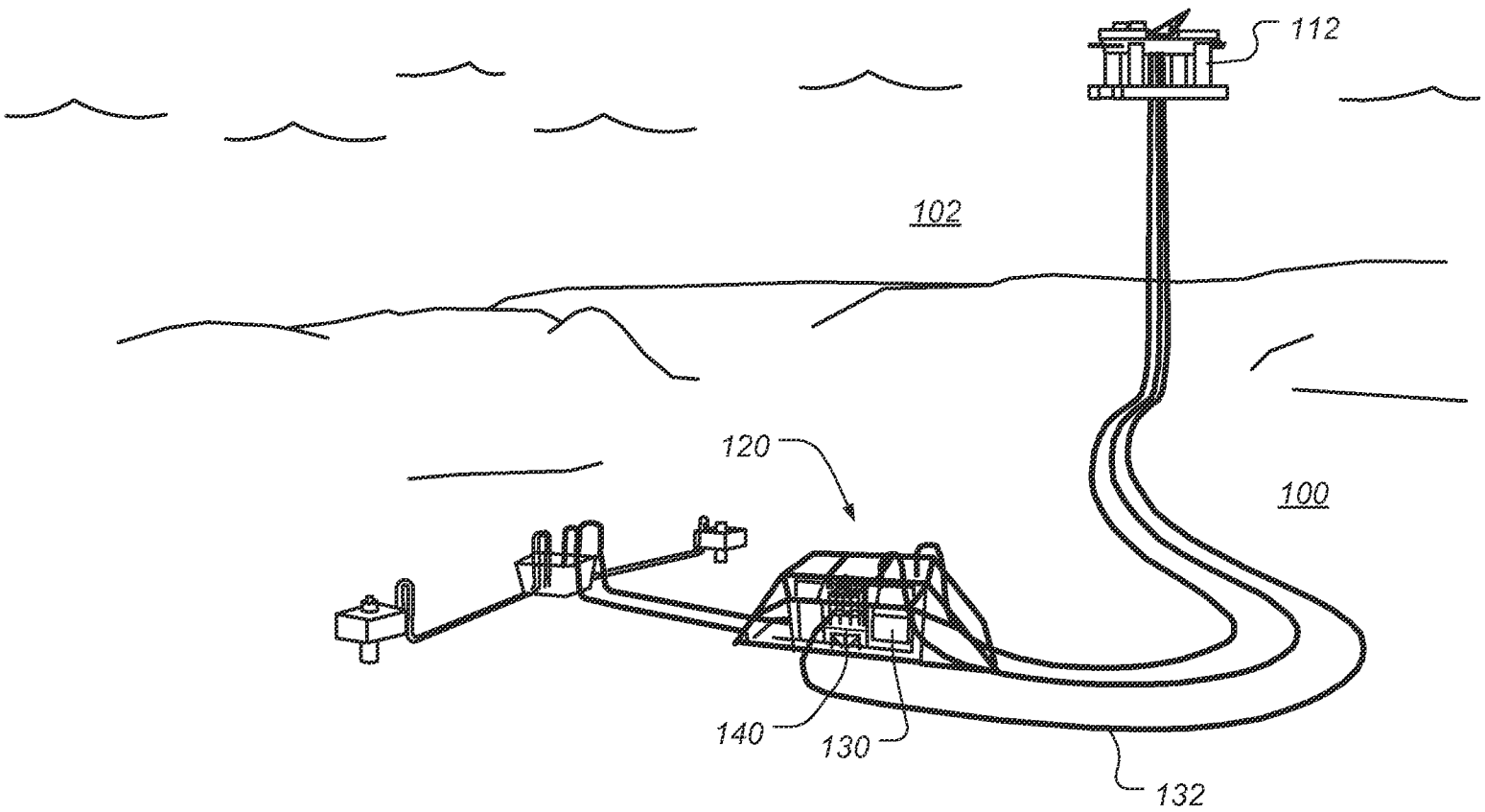
FIG. 1 is a diagram illustrating a subsea environment in which a fault tolerant subsea transformer is deployed, according to some embodiments.

FIG. 1 is a diagram illustrating a subsea environment in which a fault tolerant subsea transformer is deployed, according to some embodiments. On sea floor 100 a station 120 is shown which is downstream of several wellheads being used, for example, to produce hydrocarbon-bearing fluid from a subterranean rock formation. Station 120 includes a subsea pump module 130, which has a pump (or compressor) that is driven by an electric motor. The station 120 is connected to one or more umbilical cables, such as umbilical 132. The umbilicals in this case are being run from a platform 112 through seawater 102, along sea floor 100 and to station 120. In other cases, the umbilicals may be run from some other surface facility such as a floating production, storage and offloading unit (FPSO), or a shore-based facility. In many cases to reduce energy losses, it is desirable to transmit energy through the umbilicals at higher voltages than is used by the electric motor in pump module 130. Station 120 thus also includes a transformer 140, which according to some embodiments is a step-down transformer configured to convert the higher-voltage three-phase power being transmitted over the umbilical 132 to lower-voltage three-phase power for use by pump module 130. In addition to pump module 130 and transformer 140, the station 120 can include various other types of subsea equipment, including other pumps and/or compressors. The umbilical 132 can also be used to supply barrier and other fluids, and control and data lines for use with the subsea equipment in station 120. Note that although transformer 140 is referred to herein as a three-phase step-down transformer, the techniques described herein are equally applicable to other types of subsea transformers such as having other numbers of phases, and being of other types (e.g. step-up transformer).

Figure 2:
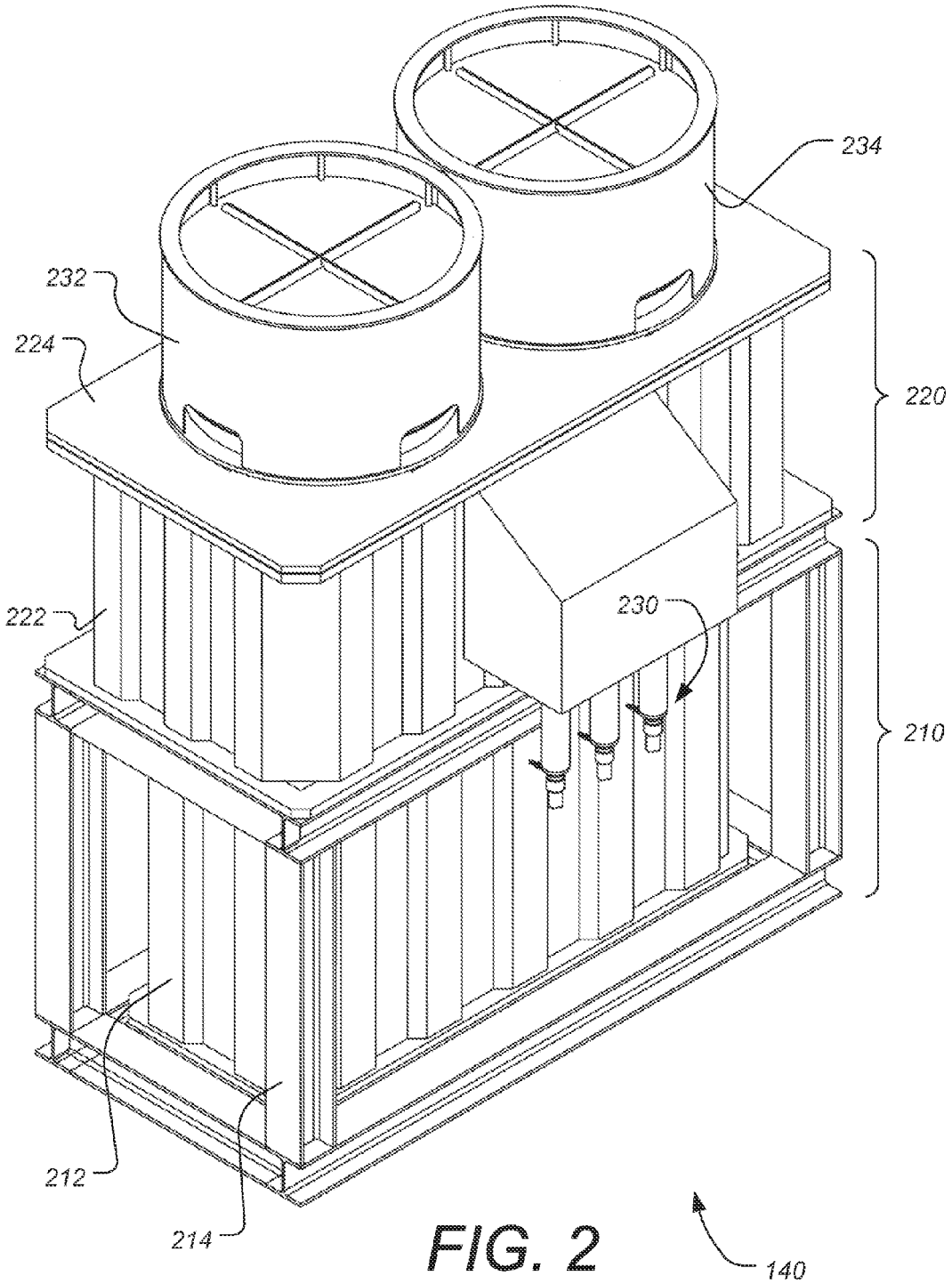
FIG. 2 is a perspective view of a fault tolerant subsea transformer, according to some embodiments.

FIG. 2 is a perspective view of a fault tolerant subsea transformer, according to some embodiments. The fault tolerant subsea transformer 140 includes two metallic tanks: lower tank 210 and upper tank 220. Lower tank 210 houses the transformer windings and core, while upper tank 220 houses instruments, electrical interconnects between exterior terminals 230, and the active transformer components. Visible in FIG. 2 is the lower tank steel wall 212 and an exterior steel frame 214. The upper tank 220 also has a surrounding wall 222 and a top lid 224. The upper tank has two metallic compensators 232 and 234 which each include flexible bellows and protective structures, and are configured to balance pressure between dielectric oil in the upper tank 220 and the exterior ambient seawater.

Figure 3A:
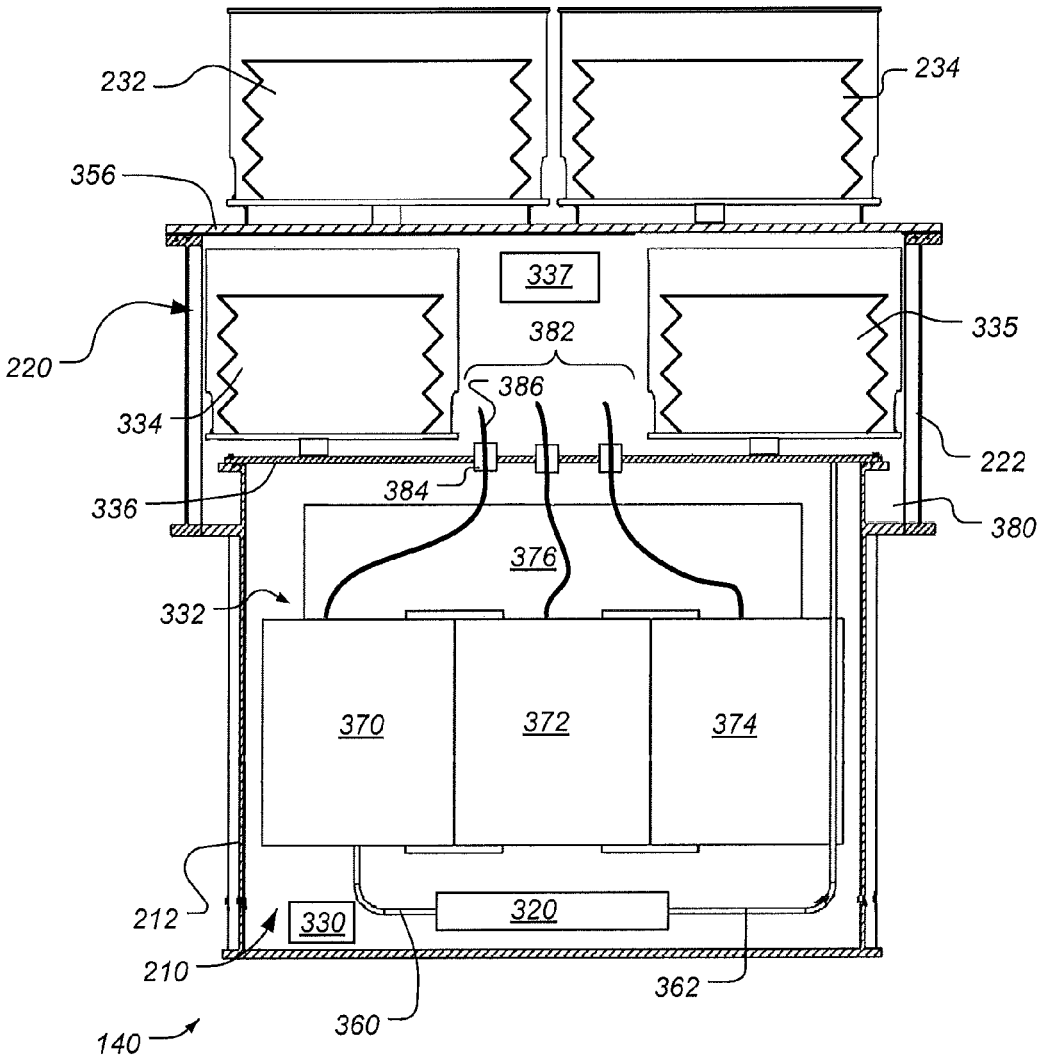
FIGS. 3A and 3B are cut-away diagrams showing various components and aspects of a fault tolerant subsea transformer, according to some embodiments.
Figure 3B:
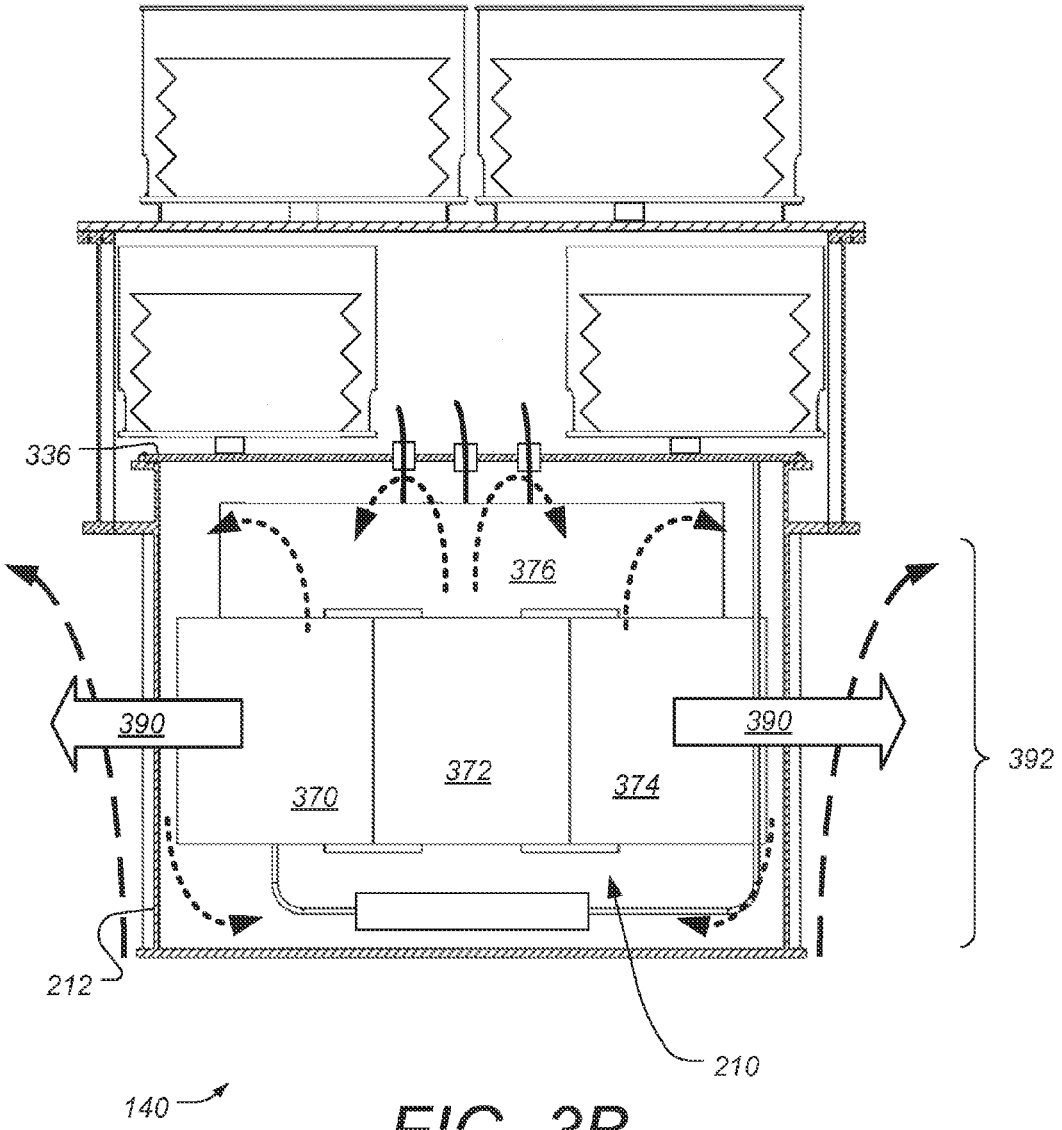
Figure 6:
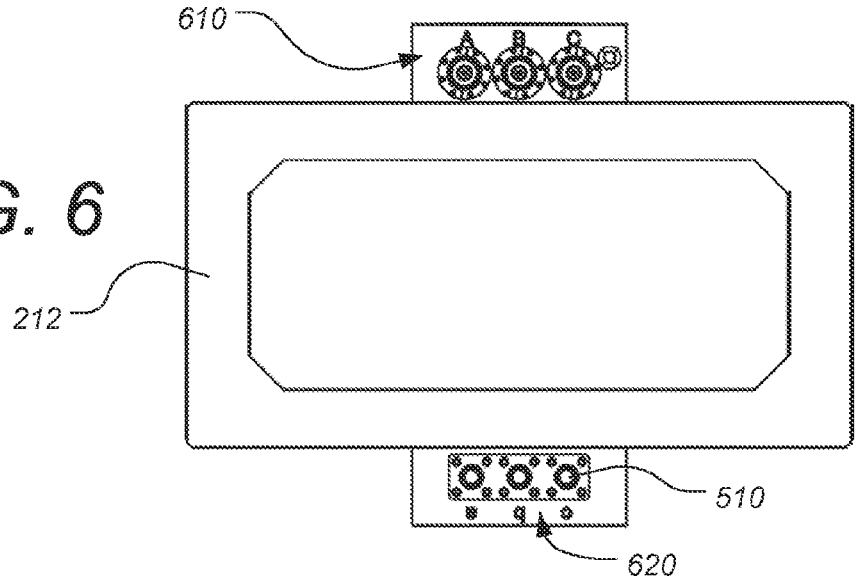

FIGS. 3A and 3B are cut-away diagrams showing various components and aspects of a fault tolerant subsea transformer, according to some embodiments. Referring to FIG. 3A, subsea transformer 140 includes a lower tank wall 212. Inside the lower tank (or transformer tank) 210 is the active portion 332 of the transformer, which includes the primary and secondary windings for the three phases as well as the transformer core. In some embodiments, the lower tank 210 may include a temperature sensor 330 to measure the temperature of dielectric oil inside the lower tank 210. The active portion 332 is sealed in the lower tank by the lower tank wall 212 and the lower tank lid 336. The upper tank wall 222 surrounds the upper tank (or instrumentation tank) 220, which includes the lower tank compensators 334 and 335 that are used to compensate the lower tank volume for pressure changes due to temperature fluctuations. Also included in upper tank 220 are instrumentation 337 and bushings for external terminals 230 (shown in FIG. 2). The lower tank compensators 334 and 335 include flexible bellow structures that are filled with oil from the lower tank such that they balance pressure between the lower tank 210 and upper tank 220. The lower tank lid 336, upper tank wall 222 and the upper tank lid 356 define the upper tank 220. Above the upper tank are the upper tank compensators 232 and 234 that are configured to compensate for pressure variations within the upper tank. The lower tanks compensators 334 and 335 are thus provided "in series" with the upper tank compensators 232 and 234.

Due to the arrangement of the tanks as shown, the transformer is fault tolerant in that it remains fully operable if one of the tank barriers fails. According to some embodiments, a subsea transformer tank sealing system is provided that combines a single lower tank wall for the active parts with a double seal philosophy between seawater and all active parts and open connections. The single wall steel lower tank allows for enhanced cooling properties and the double seal philosophy provides redundancy. A single seal failure anywhere in the system will not cause an electrical system failure.

Referring again to FIG. 3A, visible within lower tank 210 is active portion 332 of transformer 140 that includes three sets of primary and secondary windings 370, 372 and 374 that are wound around transformer core 376. Conductors 382 are electrically connected to the primary and secondary windings 370, 372 and 374 are passed through bushings in lower tank lid 336 to make electrical connection with external terminals (not visible in FIG. 3A) for both primary and secondary connections. For example, secondary phase conductor 386 is shown connected to the secondary windings of windings 370 and passes through lower tank lid 336 via bushing 384. Note that while only three conductor and bushings are visible in FIG. 3A, there are three more conductors and bushings that are not visible in FIG. 3A. Neutral conductor 360 is directly connected to the neutral node of the secondary windings for the three phases (i.e. which are arranged in a "wye" configuration). Neutral conductor 360 connects to an integrated HRG device 320, which in this case is shown below the windings 370, 372 and 374. The HRG device 320 is electrically connected via conductor 362 to ground, which can be, for example lower tank lid 336 or lower tank wall 212. According to some embodiments, the transformer tank walls are grounded and are grounded through connection to an umbilical termination head (not shown), and up to the vessel or surface facility, such as platform 112 shown in FIG. 1. According to some embodiments, the conductor from HRG device 320 passes through the lower tank lid 336 via a bushing and into the upper tank 220 where a ground fault measuring system is configured to sense current that is indicative of a ground fault. For further details of integrated HRG devices, see co-pending U.S. patent application Ser. No. 14/631,676, filed on Feb. 25, 2015, entitled "Subsea Transformer With Integrated High Resistance Ground", which is herein incorporated by reference in its entirety. For further details of monitoring systems that can detect ground faults, see co-pending U.S. patent application Ser. No. 14/631,641, filed on Feb. 25, 2015, entitled "Monitoring Multiple Subsea Electric Motors", which is herein incorporated by reference in its entirety. According to some embodiments, a seawater-based HRG device can be mounted onto the exterior of the transformer 140 and used instead of an integrated HRG device as shown in FIGS. 3A and 3B. For further details of seawater-based HRG devices, see co-pending U.S. patent application Ser. No. 14/631,661, filed on Feb. 25, 2015, entitled "Subsea Transformer With Seawater High Resistance Ground", which is herein incorporated by reference in its entirety.

The upper tank 220 is filled with an environmental fluid (such as a dielectric oil), and houses the connection systems and instrumentation. Although upper tank 220 is filled with an environmental fluid, tank 220 is designed and qualified to tolerate seawater. According to some embodiments, the upper tank 220 includes a lower volume 380, which acts as a "swamp" that can collect a certain amount of seawater. If a leakage between upper tank 220 and the sea occurs, a small amount of environmental fluid will leak to sea, but system will be operational. If leakage between upper compartment and lower compartment occur, system will also be operational. Note that the system can remain operational even in some cases where a combination of failures in both barriers was to occur. If a relatively small leakage occurs between the sea and the upper tank 220, the seawater entering the upper tank 220 will collect in the "swamp" volume 380. In such cases the main volume of upper tank 220 remains oil-filled and the system can tolerate leakage between the upper tank 220 and lower tank 210.

Visible in FIG. 3B are illustrations of internal/external fluid flow patterns, according to some embodiments. As the active portion of the transformer generates heat, the transformer oil within lower tank 210 rises and deflects off of the lower tank lid 336 as indicated by the dotted arrows. The heated oil travels close to the exterior walls 212 of tank 210 where it is cooled by ambient seawater. The heated seawater circulates as shown by the dashed arrows. In this way, heat is transported in the direction indicated by arrows 390 from the active portion of the lower tank towards the ambient seawater. Generated heat in the single wall section 392 of lower tank 210 is transported much more efficiently when compared with "tank-in-a-tank" type designs such as shown in FIG. 8.

Figure 7:
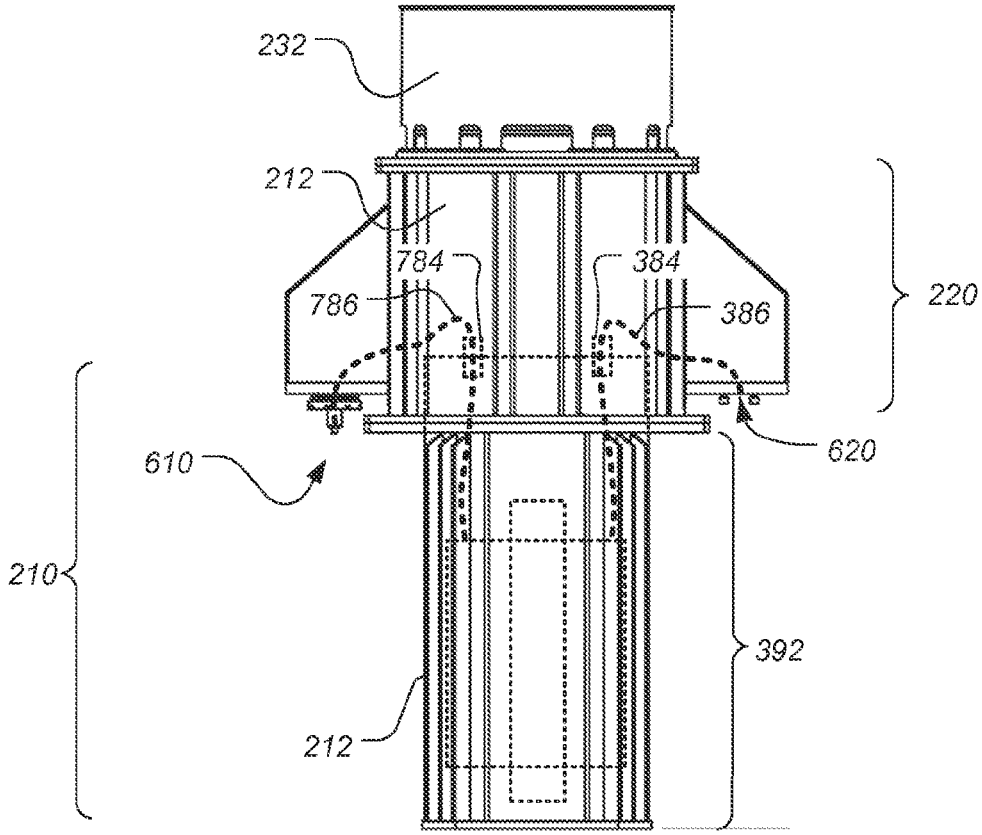

FIGS. 4, 5, 6 and 7 are top, front, bottom and side views of a fault tolerant subsea transformer, according to some embodiments. In FIG. 4, upper tank compensators 232 and 234 are visible. In FIG. 5 the secondary phase terminals, including terminal 510 is shown mounted on the exterior of the upper tank 220. Secondary phase conductors shown in dotted lines including secondary phase conductor 386 which make a conduction path between the secondary winding of windings 370 to secondary terminal 510 via busing 384. In the bottom view, FIG. 6 and in the side view FIG. 7, both the primary phase terminals 610 and the secondary terminals 620 are visible. In FIG. 7, secondary phase conductor 386 is shown in dotted line passing through bushing 384 to connect with one of the secondary terminals 610. Similarly, primary phase conductor 786 is shown in dotted line connecting with one of the primary terminals 610 via busing 784 in the lower tank lid.

FIG. 8 is a schematic diagram illustrating aspects of a known subsea transformer. In FIG. 8, which is an example of a "tank-in-a-tank" arrangement, the transformer 800 includes core and windings 810 housed within an inner tank 820. In some cases, the core and windings 810 and inner tank 820 are of similar or identical design, as is commonly used in surface applications. To provide a double barrier for use in subsea applications, the inner tank 820 is housed completely within an outer tank 830 as shown. A pressure compensator 840 is included to balance pressure between the outer tank volume and the ambient seawater. In some cases the inner wall 820 is flexible enough so as not to need a separate pressure compensation system.

While the subject disclosure is described through the above embodiments, it will be understood by those of ordinary skill in the art that modification to and variation of the illustrated embodiments may be made without departing from the inventive concepts herein disclosed. Moreover, while some embodiments are described in connection with various illustrative structures, one skilled in the art will recognize that the system may be embodied using a variety of specific structures. Accordingly, the subject disclosure should not be viewed as limited except by the scope and spirit of the appended claims.

What is claimed is:

1. A subsea transformer comprising:

a primary set of coil windings;

a secondary set of coil windings;

a first sealed tank defined by a first tank wall and housing the primary and secondary sets of coil windings and a first dielectric fluid which bathes the primary and secondary sets of coil windings, wherein the first tank wall is configured for deployment in a subsea environment, and the first tank wall comprises a first side wall that extends around the primary and secondary sets of coil windings;

a second sealed tank housing a second dielectric fluid and being positioned adjacent to the first sealed tank such that the first and second sealed tanks share a shared portion of the first tank wall, wherein the shared portion of the first tank wall comprises a portion of the first side wall, wherein a volume of said second sealed tank extends around the portion of the first side wall, and the second tank wall comprises a second side wall that extends around the volume and the portion of the first side wall;

a set of primary terminals mounted on the second sealed tank connected to a first electrical conduction path to the primary set of coil windings and passing through the second sealed tank, the shared portion of the first tank wall and into the first sealed tank; and a set of secondary terminals mounted on the second sealed tank connected to a second electrical conduction path to the secondary set of coil windings and passing through the second sealed tank, the shared portion of the first tank wall and into the first sealed tank.

2. The subsea transformer according to claim 1 wherein the shared portion of the first tank wall is less than about 50% of a total surface area of the first sealed tank, and wherein a non-shared portion of the first tank wall is configured for direct contact with ambient seawater which provides cooling to said first dielectric fluid.

3. The subsea transformer according to claim 1 wherein the subsea transformer is configured to remain operational when seawater leaks in to the second sealed tank but no leak exists between the first and second sealed tanks.

4. The subsea transformer according to claim 1 wherein the subsea transformer is configured to remain operational when a leak exists between the first and second sealed tanks but no seawater leaks into the second sealed tank.

5. The subsea transformer according to claim 1 further comprising a first pressure compensator in fluid communication with the first sealed tank and configured to balance internal pressure of the first sealed tank with ambient seawater pressure and/or pressure within the second sealed tank.

6. The subsea transformer according to claim 5 further comprising a second pressure compensator in fluid communication with the second sealed tank and configured to balance internal pressure of the second sealed tank with ambient seawater pressure.

7. The subsea transformer according to claim 6 wherein the first pressure compensator is at least partially housed within the second sealed tank.

8. The subsea transformer according to claim 1 further comprising one or more instruments housed within the second sealed tank.

9. The subsea transformer according to claim 1 further comprising a temperature sensor positioned and configured to measure temperature of the first dielectric fluid.

10. The subsea transformer according to claim 1 further comprising an integrated high resistance grounding system housed within the first sealed tank interconnected and configured to provide a high resistance ground path between a neutral node of the secondary windings and a ground.

11. The subsea transformer according to claim 1 wherein the transformer is a step-down or a step-up transformer.

12. The subsea transformer according to claim 1 wherein the volume in the second sealed tank is configured to collect seawater when seawater leaks into the second sealed tank.

13. The subsea transformer according to claim 12 wherein the subsea transformer is configured to remain operational when seawater leaks into the second sealed tank and when a leak exists between the first and second sealed tanks.

14. A subsea transformer, comprising:

a primary set of coil windings;

a secondary set of coil windings;

a first tank defined by a first tank wall, wherein the first tank houses the primary and secondary sets of coil windings and a first dielectric fluid which surrounds the primary and secondary sets of coil windings, and wherein the first tank wall is configured for deployment in a subsea environment;

a second tank positioned adjacent to the first tank and defined by a second tank wall and a shared portion of the first tank wall, wherein the second tank houses a second dielectric fluid, wherein a portion of the second tank wall extends around the shared portion of the first tank wall, and wherein a volume of the second tank between the portion of the second tank wall and the shared portion of the first tank wall is configured to collect a predetermined amount of seawater when seawater leaks into the second tank;

a set of primary terminals mounted on the second tank and connected to a first electrical conduction path to the primary set of coil windings, wherein the first electrical conduction path passes through the second tank, the shared portion of the first tank wall, and into the first tank; and a set of secondary terminals mounted on the second tank connected to a second electrical conduction path to the secondary set of coil windings, wherein the second electrical conduction path passes through the second tank, the shared portion of the first tank wall, and into the first tank.

15. The subsea transformer of claim 14, wherein the subsea transformer is configured to remain operational when an amount of seawater that leaks into the second tank is less than or equal to the predetermined amount and when a leak exists between the first and second tanks.

16. The subsea transformer of claim 14, comprising:

a first pressure compensator disposed adjacent to the second tank, wherein the first pressure compensator is in fluid communication with the second tank and configured to balance a first internal pressure of the second tank with ambient seawater pressure; and a second pressure compensator disposed in the second tank, wherein the second pressure compensator is in fluid communication with the first tank and configured to balance a second internal pressure of the first tank with the first internal pressure of the second tank.

17. The subsea transformer of claim 16, wherein the first and second pressure compensators are vertically stacked with respect to one another.

18. The subsea transformer of claim 5, wherein the first pressure compensator is at least partially housed within the second sealed tank, and the volume is offset from the first pressure compensator in the second sealed tank such that the volume is closer to the primary and secondary sets of coil windings than the first pressure compensator.

19. The subsea transformer of claim 14, wherein the shared portion of the first tank wall comprises a first portion of a first side wall of the first tank wall, wherein the portion of the second tank wall comprises a second portion of a second side wall of the second tank wall, wherein the second side wall extends around the first side wall, and wherein the volume is disposed between the first portion of the first side wall and the second portion of the second side wall.

20. The subsea transformer of claim 14, wherein the shared portion of the first tank wall is stationary.

* * * * *